United States Patent [19]

Valadez

[11] Patent Number: 4,459,716

[45] Date of Patent: Jul. 17, 1984

[54] COMBINATION GAUGE-SOCKET WRENCH

[76] Inventor: Mario Valadez, 9806 Cascade Valley, San Antonio, Tex. 78245

[21] Appl. No.: 421,984

[22] Filed: Sep. 23, 1982

[51] Int. Cl.[3] ..... B25F 1/00

[52] U.S. Cl. ..... 7/100; 7/138; 7/164; 33/168 R; 81/121 R; 81/DIG. 5

[58] Field of Search ..... 7/100, 138, 164, 169, 7/170; 33/168 R; 81/121 R, 125, DIG. 5

[56] References Cited

U.S. PATENT DOCUMENTS

| | | | |
|---|---|---|---|
| 2,492,380 | 12/1949 | Duma | 7/100 |
| 2,871,741 | 2/1959 | Weisbecker et al. | 7/100 |
| 3,045,354 | 7/1962 | Frauenholtz | 33/168 R |
| 3,680,159 | 8/1972 | Wharram | 7/100 |
| 4,291,426 | 9/1981 | Bishop, Jr. | 7/100 |

*Primary Examiner*—Roscoe V. Parker
*Attorney, Agent, or Firm*—John C. Stahl

[57] ABSTRACT

A combination gauge-socket wrench for use in removing, gapping and installing spark plugs, the gauge extending circumferentially about the upper end and increasing uniformly in thickness along its length, indicia adjacent the gauge to indicate the thickness through a selected portion of the gauge, the socket wrench being adapted to fit a conventional spark plug.

3 Claims, 6 Drawing Figures

COMBINATION GAUGE-SOCKET WRENCH

BACKGROUND OF THE INVENTION

The prior art is replete with spark plug gapping tools, exemplified by United States Letters Pat. No. 2,492,380, 2,871,741, 3,680,159 and 4,291,426. In the latter teaching, a series of flat gauge members in edge-to-edge relationship extend axially from the lower end of the combination tool. It is evident that such combination tool must be removed from the drive tool prior to using a selected gauge. Furthermore, each of said flat gauges is sized only for a specified spark plug gap.

SUMMARY OF THE INVENTION

The primary object of the invention is to provide a combination gauge-socket wrench adaptable for removing a spark plug and gapping said plug to any selected gap between the limits of said gauge.

Another object is to provide such a combination gauge-socket wrench wherein the user may interpolate between designated gauge thicknesses for gapping a spark plug to any desired intermediate gap.

Still another object is to provide such a combination gauge-socket wrench which is relatively inexpensive to manufacture, easy to use, and universal in its adaptability.

Other objects and features of the invention will become apparent to those skilled in the art from the following specification when read in the light of the annexed drawings.

DESCRIPTION OF PREFERRED EMBODIMENTS

Figure 1:
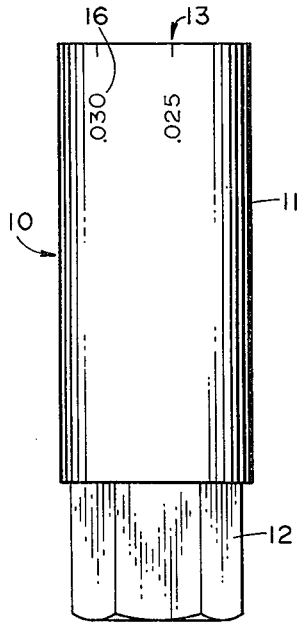
FIG. 1 is a side elevational view of a preferred embodiment of the invention.
Figure 2:
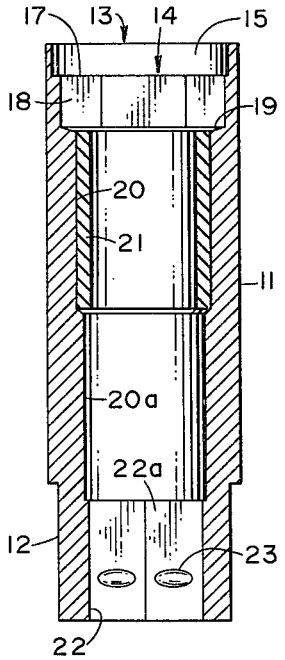
FIG. 2 is a vertical sectional view taken through the longitudinal, medial plane.
Figure 3:
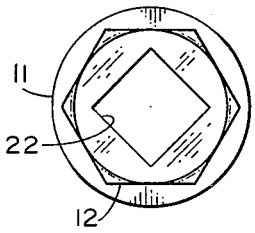
FIG. 3 is a bottom plan view.

Referring now to the drawings, wherein like reference numerals designate like or corresponding parts throughout the several views, there is shown in FIGS. 1–3 combination gauge-socket wrench 10 of the subject invention, preferably composed of hardened steel alloy and chrome plated. Gauge-socket wrench 10 is generally tubular having a cylindrical outer surface 11 and terminating downwardly in a reduced, hexagonally-shaped section 12.

For purposes of convenience only, the gauge will hereinafter be designated by reference numeral 13, while the socket wrench will be designated by reference numeral 14.

Figure 4:
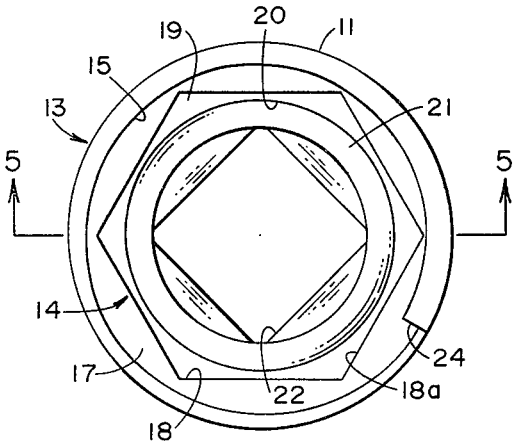
FIG. 4 is a greatly enlarged, top plan view.
Figure 5:
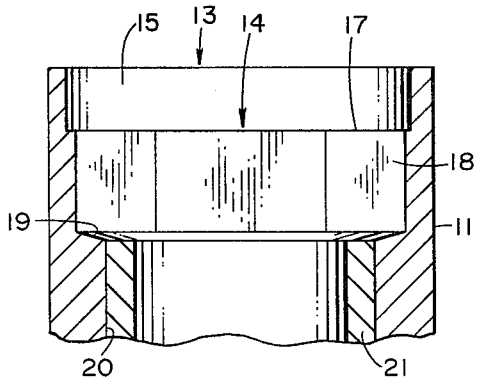
FIG. 5 is a fragmentary, greatly enlarged vertical sectional view, taken on the line 5—5 of FIG. 4, looking in the direction of the arrows.

As best seen in FIGS. 4–5 of the drawings, gauge 13 extends circumferentially about the upper end with the inner vertical wall 15 diverging uniformly with respect to outer surface 11, preferably in a clockwise direction, whereby the thickness of said gauge varies from approximately 0.020 to 0.065 inches in width. Indicia 16 are stamped or otherwise provided on the upper, outer surface 11 to indicate the corresponding thicknesses of the gauge at each designated point. It is to be understood that the invention is not to be restricted solely to a gauge ranging from 0.020–0.065 inches with indicia in 0.005 inch increments. For example, the gauge may range in thickness from 0.030 to 0.050 inches with indicia in 0.002 inch increments, or 0.034 to 0.050 inches with indicia in 0.001 inch increments. Gauge 13 thus formed terminates inwardly in horizontally extending, gradually diminishing arcuate shoulder 17.

Socket wrench 14 consists of a hollow, hexagonally or other polygonally-shaped cavity 18 which surfaces upwardly in shoulder 17 and is dimensioned to receive the hexagonal shoulder of a conventional spark plug; cavity 18 terminates downwardly in angularly inclined shoulder 19 with reduced diametrical cylindrical section 20 therebelow which generally conforms to the ceramic insulator and connector of said spark plug; desirably a soft rubber sleeve 21 or the like is carried in cylindrical section 20 to protect the corresponding spark plug parts from damage. If desired, the lower cylindrical section **20*a* may be the same diameter as section 20 or of slightly reduced diameter, said section 20 or 20*a* communicating downwardly with essentially square opening 22 which corresponds approximately to section 12 in height and surfaces downwardly and is adapted to receive the square drive of a ratchet or other tool used to remove and install plugs. One or more walls 22*a* of opening 22 may be provided with recesses 23** to accommodate detent balls or the like on the drive of said tool.

As best seen in FIG. 4, the greatest thickness of gauge 13 terminates in shoulder 24 which desirably is radially aligned with the approximate midpoint of one face **18*a* of the polygonally-shaped cavity 18**.

Figure 6:
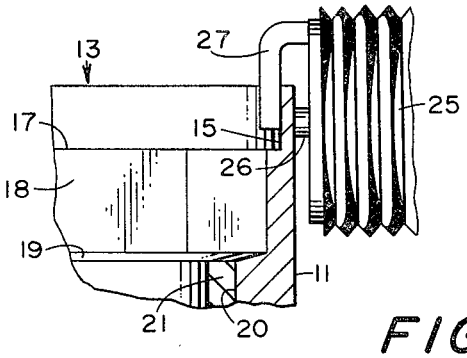
FIG. 6 is a fragmentary, greatly enlarged vertical sectional view showing the manner of gapping a spark plug utilizing the subject invention.

Referring now to FIG. 6 of the drawings, there is shown the method of gapping a conventional spark plug 25 including axially extending, insulated electrode 26 and L-shaped, radially extending electrode 27, longitudinally spaced therefrom. Plug 25 is normally held horizontally with electrode 27 passed downwardly and inwardly of wall 15 any desired depth or unitl stopped by shoulder 17, preferably first positioned at a point at least slightly smaller than the desired gap and then moved in a clockwise direction until stopped by electrodes 26, 27 bearing against outer surface 11 and wall 15, respectively; the user may then check the gap as indicated by indicia 16. If required, the spacing or gap between electrodes 26, 27 may then be adjusted in a conventional manner and the spark plug rechecked in the manner described.

It should be understood, of course, that the foregoing disclosure relates to only preferred embodiments of the invention and that numerous modifications or alterations may be made therein without departing from the spirit and scope of the invention as set forth in the appended claims.

What is claimed is:

1. A combination gauge-socket wrench comprising a generally tubular body including an upper cylindrical outer surface, a gauge circumferentially about the upper end of said gauge-socket wrench, said gauge increasing in thickness uniformly along its length, indicia in said outer surface in proximity to said upper end corresponding to the thickness through a selected portion of said gauge, a socket wrench below said gauge, and an opening in said body adapted to receive the stem of a drive tool for installing and removing spark plugs.

2. The invention of claim 1 wherein said gauge uniformly increases in a clockwise direction.

3. The invention of claim 1 wherein said gauge ranges from 0.020–0.065 inches in thickness and said indicia on said outer surface is in 0.005 inch increments.

* * * * *